US009131749B2

(12) United States Patent
Roether et al.

(10) Patent No.: US 9,131,749 B2
(45) Date of Patent: Sep. 15, 2015

(54) WOVEN TEXTILE BAG

(75) Inventors: Julia Roether, Portland, OR (US); Thomas G. Bell, Portland, OR (US); Tory M. Cross, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/599,531

(22) Filed: Aug. 30, 2012

(65) Prior Publication Data

US 2013/0051712 A1 Feb. 28, 2013

Related U.S. Application Data

(60) Provisional application No. 61/529,049, filed on Aug. 30, 2011.

(51) Int. Cl.

| | |
|---|---|
| ***B65D 30/04*** | (2006.01) |
| ***B65D 30/06*** | (2006.01) |
| ***B65D 30/02*** | (2006.01) |
| ***B65D 33/02*** | (2006.01) |
| ***B65D 30/08*** | (2006.01) |
| ***D03D 1/04*** | (2006.01) |
| ***A43B 23/02*** | (2006.01) |
| ***A43B 23/04*** | (2006.01) |
| ***D03D 11/02*** | (2006.01) |
| ***A45C 1/02*** | (2006.01) |
| *A45C 13/02* | (2006.01) |

(52) U.S. Cl.

CPC ..... *A43B 23/024* (2013.01); *A43B 23/0245* (2013.01); *A43B 23/04* (2013.01); *A45C 1/024* (2013.01); *D03D 1/04* (2013.01); *D03D 11/02* (2013.01); *A45C 2013/026* (2013.01)

(58) Field of Classification Search

CPC ..... A45C 3/00; A45C 13/02
USPC ..... 383/109, 117, 118, 119; 139/389
See application file for complete search history.

(56) References Cited

U.S. PATENT DOCUMENTS

| | | | | |
|---|---|---|---|---|
| 264,526 | A | 9/1882 | Grauwiler | |
| 735,560 | A * | 8/1903 | Muller | 383/76 |
| 768,378 | A * | 8/1904 | Knibbs | 139/389 |
| 1,423,524 | A | 7/1922 | Hill et al. | |
| 1,612,022 | A | 12/1926 | Howarth | |

(Continued)

FOREIGN PATENT DOCUMENTS

| | | | |
|---|---|---|---|
| CA | 2478447 | A1 | 2/2005 |
| CN | 101237788 | A | 8/2008 |

(Continued)

OTHER PUBLICATIONS

Non-Final Office Action in U.S. Appl. No. 13/599,544 mailed Sep. 30, 2013, 18 pages.

(Continued)

*Primary Examiner* — Jes F Pascua
*Assistant Examiner* — Derek Battisti
(74) *Attorney, Agent, or Firm* — Shook, Hardy & Bacon L.L.P.

(57) ABSTRACT

Woven textile structures constructed using dual-loom technology are provided. Filaments are woven in such a way as to create a first set of different discrete layers of the same fabric in some regions of the textile and a second set of discrete layers of the same fabric at other regions of the same textile. The different layers are used to construct various textile structures such as a woven bag.

14 Claims, 3 Drawing Sheets

(56) References Cited

U.S. PATENT DOCUMENTS

| | | | | | |
|---|---|---|---|---|---|
| 1,902,553 | A | | 3/1933 | Goldsmith | |
| 1,983,452 | A | | 12/1934 | Gwaltney | |
| 2,340,578 | A | | 2/1944 | Cairns | |
| 2,350,455 | A | | 6/1944 | Hendley | |
| 2,425,683 | A | | 8/1947 | Martin | |
| 3,807,200 | A | | 4/1974 | Liwski | |
| 4,232,458 | A | | 11/1980 | Bartels | |
| 4,674,664 | A | | 6/1987 | Simon | |
| 4,807,299 | A | * | 2/1989 | Nattrass et al. | 383/109 |
| 5,052,555 | A | | 10/1991 | Harmon | |
| 5,100,005 | A | | 3/1992 | Noble et al. | |
| 5,222,812 | A | | 6/1993 | Cuddy et al. | |
| 5,351,352 | A | | 10/1994 | Chillemi | |
| 5,419,376 | A | | 5/1995 | Hawkins et al. | |
| 5,456,062 | A | * | 10/1995 | Wechsler | 53/468 |
| 5,692,660 | A | * | 12/1997 | Stewart | 224/581 |
| 5,813,445 | A | | 9/1998 | Christman | |
| 5,881,850 | A | | 3/1999 | Murdoch | |
| 5,980,108 | A | * | 11/1999 | Pasbrig | 383/75 |
| 5,989,660 | A | * | 11/1999 | Moriwaki et al. | 428/35.2 |
| 6,056,438 | A | * | 5/2000 | Bradley | 383/66 |
| 6,126,003 | A | | 10/2000 | Brouard | |
| 6,129,254 | A | | 10/2000 | Yu | |
| 6,186,662 | B1 | * | 2/2001 | Jackson | 383/16 |
| 6,299,962 | B1 | | 10/2001 | Davis et al. | |
| 6,349,750 | B1 | | 2/2002 | Fujiwara | |
| 6,931,762 | B1 | | 8/2005 | Dua | |
| 7,069,961 | B2 | * | 7/2006 | Sollars, Jr. | 139/389 |
| 7,293,371 | B2 | | 11/2007 | Aveni | |
| 7,637,032 | B2 | | 12/2009 | Sokolowski et al. | |
| 7,836,917 | B1 | | 11/2010 | Osborne | |
| 7,836,918 | B1 | | 11/2010 | Osborne | |
| 7,841,369 | B1 | | 11/2010 | Osborne | |
| 2004/0139629 | A1 | | 7/2004 | Wiener | |
| 2005/0193592 | A1 | | 9/2005 | Dua et al. | |
| 2006/0283680 | A1 | | 12/2006 | Hollin et al. | |
| 2007/0019891 | A1 | | 1/2007 | Daniel | |
| 2007/0084866 | A1 | * | 4/2007 | Saeugling | 220/495.06 |
| 2007/0137959 | A1 | | 6/2007 | Zauderer | |
| 2007/0227038 | A1 | | 10/2007 | Edington et al. | |
| 2008/0035694 | A1 | | 2/2008 | Sisk et al. | |
| 2008/0110049 | A1 | | 5/2008 | Sokolowski et al. | |
| 2008/0237068 | A1 | | 10/2008 | Melamed | |
| 2009/0129866 | A1 | * | 5/2009 | Smallwood et al. | 405/16 |
| 2009/0194541 | A1 | | 8/2009 | Mayo | |
| 2010/0172603 | A1 | * | 7/2010 | Lin | 383/116 |
| 2011/0088285 | A1 | | 4/2011 | Dorjan et al. | |
| 2011/0113650 | A1 | | 5/2011 | Hurd et al. | |
| 2011/0302804 | A1 | | 12/2011 | Hooper | |
| 2012/0198720 | A1 | | 8/2012 | Farris et al. | |

FOREIGN PATENT DOCUMENTS

| | | | |
|---|---|---|---|
| CN | 101485513 | A | 7/2009 |
| CN | 101524210 | A | 9/2009 |
| CN | 101562999 | A | 10/2009 |
| CN | 201365624 | Y | 12/2009 |
| CN | 201480395 | U | 5/2010 |
| JP | S62282036 | A | 12/1987 |
| JP | 2633183 | B2 | 7/1997 |
| WO | 2007067574 | A2 | 6/2007 |
| WO | 2008063385 | | 5/2008 |
| WO | 2010128979 | A2 | 11/2010 |

OTHER PUBLICATIONS

Notification of Transmittal of the International Search Report and the Written Opinion of the International Searching Authority, or the Declaration in PCT/US2012/53190 mailed Nov. 13, 2012, 10 pages.

Notification of Transmittal of the International Search Report and the Written Opinion of the International Searching Authority, or the Declaration in PCT/US2012/53193 mailed Nov. 23, 2012, 27 pages.

Notification of Transmittal of the International Search Report and the Written Opinion of the International Searching Authority, or the Declaration in PCT/US2012/53194 dated Nov. 30, 2012, 15 pages.

Notification of Transmittal of the International Search Report and the Written Opinion of the International Searching Authority, or the Declaration in PCT/US2012/053160 mailed Dec. 7, 2012, 55 pages.

Notice of Allowance and Fee(s) Due in U.S. Appl. No. 13/599,544 mailed Apr. 25, 2014, 19 pages.

Notice of Allowance and Fee(s) Due in U.S. Appl. No. 13/599,544 mailed Jan. 13, 2014, 12 pages.

Non-Final Office Action in U.S. Appl. No. 13/599,476 mailed Feb. 11, 2014, 20 pages.

Final Office Action dated Oct. 14, 2014 in U.S. Appl. No. 13/599,476, 10 pages.

European Supplemental Search Report dated Jan. 23, 2015 in Application No. 1282881.8, 7 pages.

European Extended Search Report dated Apr. 1, 2015 in Application No. 12827788.6, 7 pages.

European Search Report dated May 28, 2015 in Application No. 12828012.0, 8 pages.

Non-Final Office Action dated Jun. 4, 2015 in U.S. Appl. No. 13/599,512, 17 pages.

* cited by examiner

WOVEN TEXTILE BAG

CROSS-REFERENCE TO RELATED APPLICATIONS

This application claims the benefit of U.S. Provisional Application No. 61/529,049, filed Aug. 30, 2011, entitled "Woven Textile Apparel and Accessories;" and is related by subject matter to the following concurrently filed U.S. patent applications: U.S. patent application Ser. No. 13/599,512, entitled "Woven Textile Shoes;" U.S. patent application Ser. No. 13/599,544, entitled "Woven Textile Accessories" and U.S. patent application No. 13/599,476, entitled "Woven Textile Organizer For Bags." The entirety of the aforementioned applications are incorporated by reference herein.

STATEMENT REGARDING FEDERALLY SPONSORED RESEARCH OR DEVELOPMENT

Not applicable.

TECHNICAL FIELD

The present invention relates to woven textile accessories. More specifically, the present invention relates to a woven bag such as a woven duffel-type bag.

BACKGROUND

Traditionally, apparel and accessories such as bags, shoes, and jackets have been constructed by stitching or affixing together different panels of textile materials. With heavy or repetitive use, the textile panels can rip or separate along the affixed seams which limit the lifespan of these structures. As well, this mode of construction is typically labor-intensive because the different panels of textile materials need to be cut and sewn together.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, the present invention is directed toward constructing a variety of textile structures from a multi-layer woven fabric using dual-loom technology. The dual-loom technology is used to weave filaments in such a way as to create a first set of different discrete layers of the same fabric in some regions of a textile and a second set of different discrete layers of the same fabric at other regions of the same textile. The different layers may be used to construct various textile structures, such as a woven bag. Because the layers that define the different textile structures are continuously woven from the same filaments, there is minimal need to sew different pieces of material together to create the structure. The result is a durable woven textile structure that resists heavy, repetitive use better than standard stitched structures. This mode of manufacturing can also significantly reduce manufacturing costs because it is less labor intensive.

BRIEF DESCRIPTION OF THE DRAWINGS

Examples are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, the present invention is directed towards constructing a variety of textile garments and/or accessories from a multi-layer woven fabric using dual-loom technology. The dual-loom technology is used to weave filaments in such a way as to create a first set of different discrete layers of the same fabric in some regions of a textile and a second set of different discrete layers of the same fabric at other regions of the same textile. The different layers may be used to construct various textile structures, such as a woven bag. Because the layers that define the different textile structures are continuously woven from the same filaments, there is minimal need to sew different pieces of material together to create the structure. The result is a durable woven textile structure that resists heavy, repetitive use better than standard stitched structures. This mode of manufacturing can also significantly reduce manufacturing costs because it is less labor intensive.

Air-jet looms and/or water-jet looms may be used to construct bags or other types of apparel and/or accessories in accordance with the present invention, some examples of which are described herein. One example of suitable air-jet looms for use in practicing methods in accordance with the present invention and in constructing woven textile items in accordance with the present invention is air-jet looms available from Dornier Machinery Corporation of Charlotte, N.C.

Figure 1:
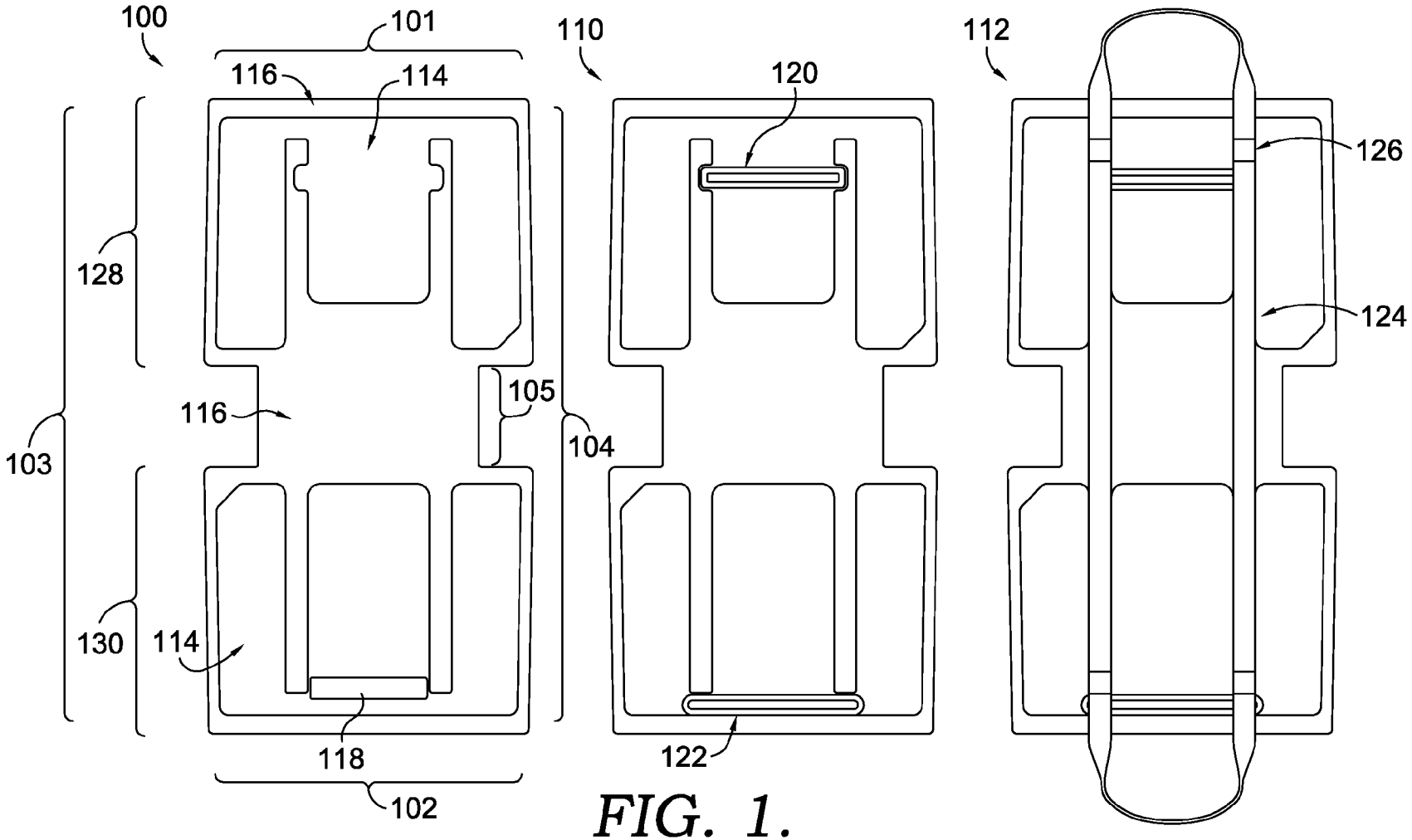
FIG. 1 depicts several views of woven panels used to construct a bag in an embodiment of the present invention.

FIG. 1 illustrates several woven panels in varying stages of finish that may be used to construct a woven bag. The panels in FIG. 1 comprise panel 100, panel 110, and panel 112. The panel 100 comprises generally a top side 101, a bottom side 102, a first side 103, and a second side 104. The first side 103 and the second side 104 may be divided into a first region 128 located adjacent to the top side 101, a second region 130 opposite of the first portion 128 and located adjacent to the bottom side 102, and mid-region 105 disposed between the first region 128 and the second region 130. The sides and/or regions 101, 102, 103, 104, 128, 130, and 105 denote general areas of the woven panel 100 and are not meant to indicate predetermined lengths, orientations, widths, or proportions. The panel 100 comprises one more single layer woven regions 116 and one or more dual layer woven regions 114. The regions 116 may be formed as a single panel of fabric of up to eight layers of thickness. The regions 116 may be woven of nylon or polyester filamentary materials, but other filamentary materials may also be used. The filaments are interwoven in a locking pattern that provides substantial stability to the woven bag.

The regions 114 contiguously extend from the regions 116. In one aspect, the regions 114 comprise two panels that partially define a cavity, channel, or pocket. The two panels each comprise a single fabric of up to four layers of thickness. The two panels are integrally woven from the regions 116 using the same plurality of filaments that make up the regions 116. The two panels of the regions 114 may have different structural properties and/or may comprise different materials as compared to one another. For instance, the exterior facing panel may be formed using heavy duty ballistic-type materials to impart resistance to wear-and tear, and the interior facing panel may be formed using lightweight-type materials. In another aspect, the exterior facing panel may be woven to create a mesh-like or web-like arrangement; this may be advantageous in constructing a pocket that is substantially see-through from an exterior aspect.

In some aspects, the regions 114 may comprise more than two panels. For instance, the exterior facing panel may be further woven to create two additional panels of up to two layers of thickness. This may be beneficial in creating "a pocket on a pocket." Likewise, the interior facing panel may be further woven to create two additional panels of up to two layers of thickness. Thus, some areas of the regions 114 may comprise up to four panels with each panel comprising up to two layers of thickness. Any and all such aspects are contemplated as being within the scope of the invention.

The regions 114 and 116 may be interchangeable. In other words, the regions 114 may comprise a single panel of fabric of up to eight layers of thickness, and the regions 116 may comprise two panels with each panel comprising a single fabric of up to four layers of thickness.

The regions 114 and 116 may be configured or positioned in a variety of ways to create different structural and functional properties. For instance, the single panel areas may be located to provide reinforcement in portions of the bag subject to wear-and-tear (e.g., along the perimeter of the bag, adjacent to a handle, and/or the bottom of the bag. The multi-panel areas may be located to provide pockets, cavities, or channels.

The panel 100 further includes area 118. In one aspect, the area 118 may comprise an open area that is constructed by altering the weaving pattern of the surrounding regions to create the open area. The area 118 may also comprise an open area formed by die cutting or incising the panel 100. In either case, the open area may be reinforced by, for example, stitching. In another aspect, the area 118 may comprise a reinforcement area comprising a single fabric of up to eight layers of thickness, which may be further reinforced by, for example, stitching. Any and all such aspects are contemplated as being within the scope of the invention.

The panel 110 depicts the panel 100 at a slightly later stage in construction. The discussion set forth previously with respect to the panel 100 is equally applicable to the panel 110. Besides the regions 114 and 116 depicted in the panel 100, the panel 110 further comprises the areas 120 and 122. The areas 120 and 122 may comprise open areas constructed by altering the weaving patterns of the surrounding areas. As well, the areas 120 and 122 may comprise open areas that have been constructed by die cutting the panel 110. In either case, the open areas may be reinforced by, for example, stitching. The areas 120 and 122 may also comprise reinforcement areas having a single layer of fabric of up to eight layers of thickness. In yet another aspect, the areas 120 and 122 may comprise handles that have been affixed to the woven panel 110. Any and all such aspects are contemplated as being within the scope of the invention.

The panel 112 depicts the panel 100 at a still later stage of construction. The panel 112 comprises a handle 124. The handle 124, in one aspect, may be affixed to the panel 112 using affixing technologies such as stitching, adhesives, heat press, ultrasonic welding, and the like. In another aspect, the handle 124 may be woven using dual-loom technology as discussed above. In this case, the handle 124 is integrally woven from the surrounding areas and may contiguously extend from the edge of the panel 112 at, for example, the tope side 101 and the bottom side 102. Different areas of the handle 124 may be reinforced by, for example, stitching and/or altering the weaving pattern (e.g., area 126). Any and all such aspects are contemplated as being within the scope of the invention.

The panels 100, 110, and 112 may be woven so that a graphic design is incorporated in to the weave. The graphic design may be of the same color as the rest of the panels 100, 110, and 112, or, alternatively, the graphic design may be woven using one or more different filament colors. In one aspect, the graphic design may comprise a logo.

Figure 2:
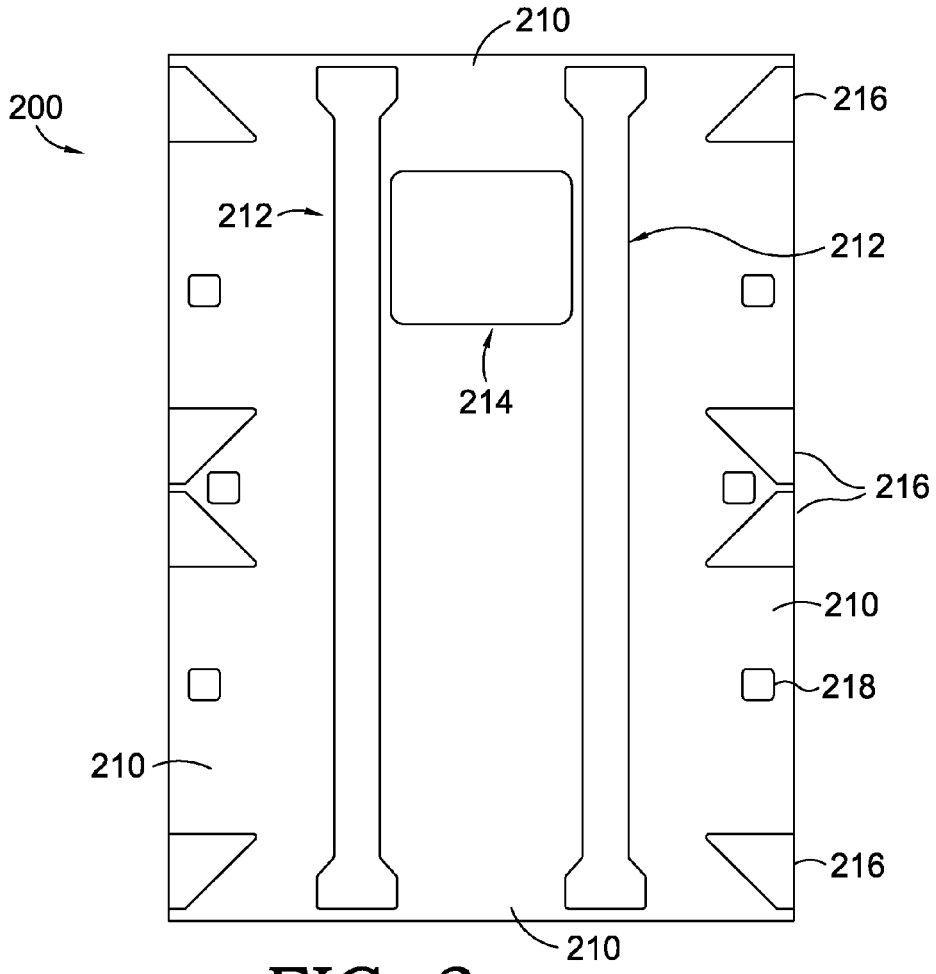
FIG. 2 depicts a woven panel used to construct a bag in an embodiment of the present invention.

Turning now to FIG. 2, another example is provided of a woven panel 200 used to construct a woven bag. The woven panel 200 comprises region 210. The region 210, in turn, may comprise a single panel of fabric of up to eight layers of thickness. The panel 200 also comprises a dual or multi-layer pocket region, show as region 214. Another dual or multi-layer region includes regions 216. Regions 216 form triangular-shaped pockets when the woven bag is constructed from the woven panel 200. Although triangular-shaped pockets are shown, additional shaped pockets are contemplated such as square shaped, rectangular shaped, circular shaped, and the like.

The woven panel 200 further comprises areas 218. In one aspect, the areas 218 may comprise reinforcement regions constructed by altering the weaving pattern as compared to the surrounding regions (e.g., region 210). In another aspect, the areas 218 may comprise a single layer area that is reinforced by, for example, stitching. The woven panel 200 additionally comprises areas 212. The areas 212 may comprise single-layer reinforcement strips created by altering the weaving pattern as compared to surrounding regions. A handle, such as the handle 124 of FIG. 1, may later be affixed to the areas 212 using traditional affixing technologies. The areas 212 may also comprise dual-layer channels that may be suitable for inserting padding, support materials, and the like. In another example, the areas 212 may comprise a woven handle that is integrally woven from the surrounding region 210 from the same plurality of filaments that make up the surrounding region 210. Any and all such aspects are contemplated as being within the scope of the invention.

Figure 3:
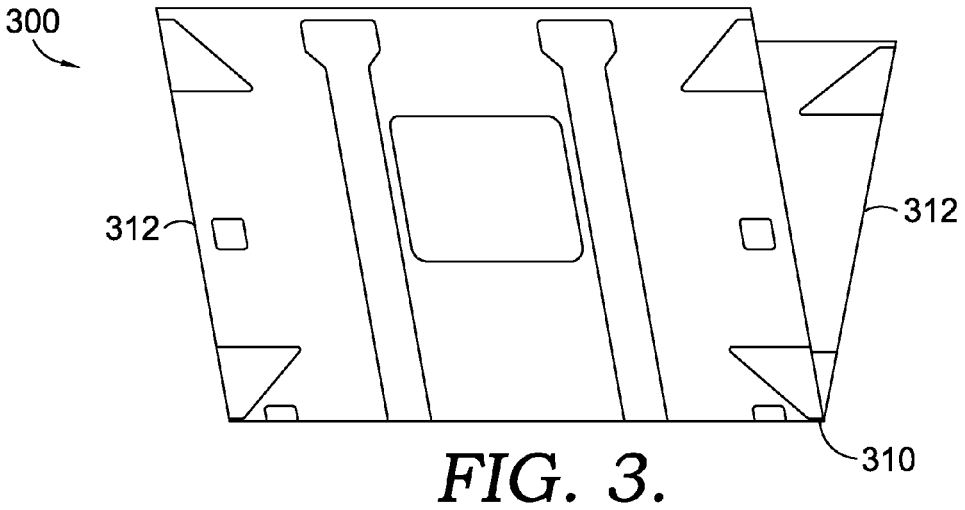
FIG. 3 depicts how a woven bag is constructed using a woven panel in an embodiment of the present invention.
Figure 4:
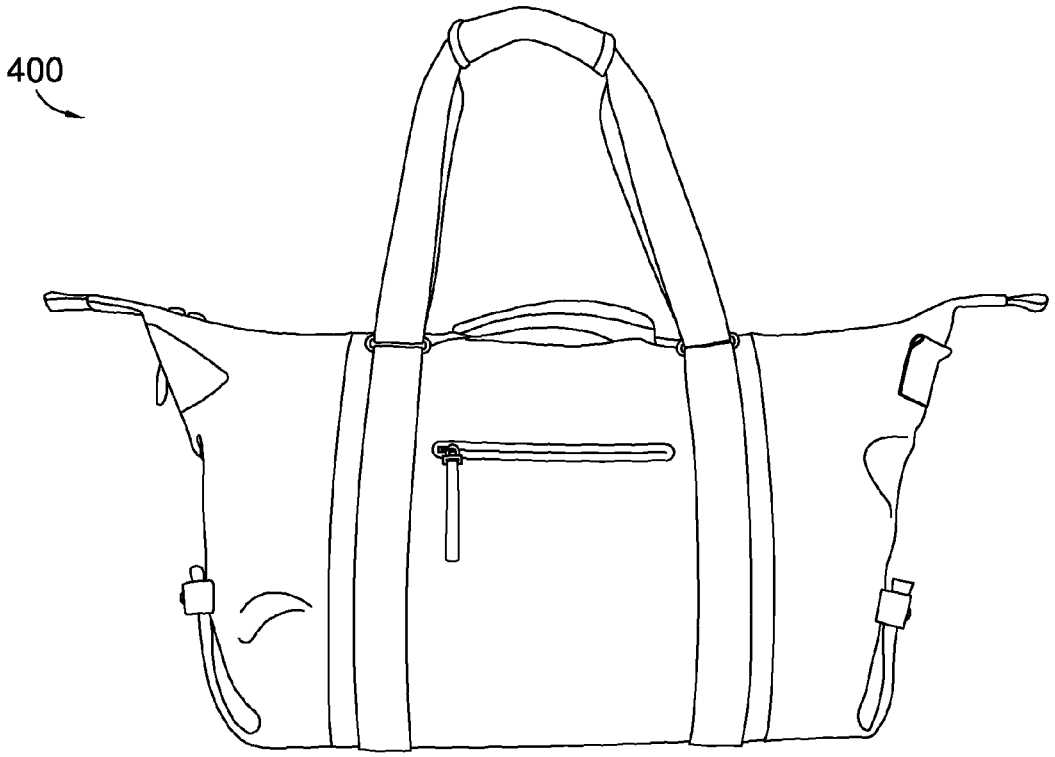
FIG. 4 depicts a woven bag constructed from a woven panel.

FIG. 3 illustrates how a woven panel 300 (such as, for example, the woven panel 200 of FIG. 2) is manipulated to construct a woven bag. The woven panel 300 is folded at approximately its mid-point 310 to create the woven bag. Edges 312 of the woven panel 300 may be affixed together using, for example, stitching, ultrasonic welding, a heat press, and the like. FIG. 4 depicts an exemplary woven bag 400 created from a woven panel such as the woven panel 200 of FIG. 2 or the woven panels 100, 110, and 112 of FIG. 1. The woven bag 400 is manufactured with minimal stitching which not only decrease manufacturing time but increases resistance to wear-and-tear.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the claims.

What is claimed is:

1. A woven bag, the woven bag comprising:

a woven panel woven from a plurality of filaments, the woven panel having a top side and an opposite bottom side, and a first side and an opposite second side, the first side and the opposite second side divided into:

(A) a first region adjacent to the top side of the woven panel, the first region having one or more single layer woven regions and one or more additional regions comprising at least a first woven layer and a second woven layer, both the first woven layer and the second woven layer contiguously woven from the one or more single woven regions, wherein at least a portion of the one or more single layer woven regions forms a perimeter border around the one or more additional regions on at least the top side, a portion of the first side, and a portion of the opposite second side of the woven panel, (B) a second region adjacent to the bottom side of the woven panel and opposite of the first region, the second region having one or more single layer woven regions and one or more additional regions comprising at least a first woven layer and a second woven layer, both the first woven layer and the second woven layer contiguously woven from the one or more single woven regions, wherein at least a portion of the one or more single layer woven regions forms a perimeter border around the one or more additional regions on at least the bottom side, a portion of the first side, and a portion of the opposite second side of the woven panel, and (C) a mid-region interposed between the first region and the second region, the mid-region comprising only a single layer woven region that is contiguously woven from the one or more single layer woven regions at the first region of the woven panel and the one or more single layer woven regions at the second region of the woven panel, wherein the woven panel is affixed in one or more areas to form the woven bag.

2. The woven bag of claim 1, wherein the woven panel further comprises one or more reinforced areas.

3. The woven bag of claim 2, wherein the one or more reinforced areas are constructed by altering a weaving pattern of the woven panel.

4. The woven bag of claim 2, wherein the one or more reinforced areas are reinforced by stitching.

5. The woven bag of claim 1, wherein the one or more additional regions comprise at least one of a channel, a pocket, or an opening.

6. The woven bag of claim 1, wherein the woven panel further comprises one or more apertures.

7. The woven bag of claim 6, wherein the one or more apertures are constructed by altering a weaving pattern of the woven panel.

8. The woven bag of claim 6, wherein the one or more apertures are constructed by incising the woven panel.

9. The woven bag of claim 6, wherein the one or more apertures are reinforced by stitching.

10. A woven bag, the woven bag comprising:

a woven panel having a top side and an opposite bottom side, and a first side and an opposite second side, the first side and the opposite second side divided into: 1) a first region adjacent to the top side of the woven panel, the first region having preconfigured single layer regions and preconfigured dual layer regions, the single layer regions and the dual layer regions woven from a same plurality of filaments and contiguously extending from each other, wherein at least a portion of the single layer regions forms a perimeter border around the dual layer regions 2) a second region adjacent to the bottom side of the woven panel and opposite of the first region, the second region having preconfigured single layer regions and preconfigured dual layer regions, the single layer regions and the dual layer regions at the second region woven from a same plurality of filaments and contiguously extending from each other, wherein at least a portion of the single layer regions forms a perimeter border around the dual-layer regions, and 3) a mid-region interposed between the first region and the second region, the mid-region having only a preconfigured single layer region that is contiguously woven from the same plurality of filaments as the single layer regions of the first region and the single layer regions of the second region, wherein the woven panel is joined together at one or more areas to construct the woven bag.

11. The woven bag of claim 10, wherein the woven bag further comprises one or more handles.

12. The woven bag of claim 11, wherein the one or more handles are fixedly attached to the woven panel.

13. The woven bag of claim 11, wherein the one or more handles are woven from the same plurality of filaments as the woven panel.

14. The woven bag of claim 10, wherein the plurality of filaments comprise at least one of a nylon-type filament or a polyester-type filament.

* * * * *